US006405485B1

(12) United States Patent
Itami et al.

(10) Patent No.: US 6,405,485 B1
(45) Date of Patent: Jun. 18, 2002

(54) DOOR CONTROL EQUIPMENT

(75) Inventors: Eiji Itami, Toyota; Ryoichi Fukumoto, Nagoya; Katsuhisa Yamada, Toyota; Masao Ohhashi, Kariya; Shintaro Suzuki, Kasugai, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/449,677

(22) Filed: Nov. 30, 1999

(30) Foreign Application Priority Data

Nov. 30, 1998 (JP) ..... 10-340536

(51) Int. Cl.[7] ..... E06B 1/00
(52) U.S. Cl. ..... 49/280; 49/360
(58) Field of Search ..... 49/360, 362, 279, 49/280; 192/140, 143

(56) References Cited

U.S. PATENT DOCUMENTS 3,662,491 A * 5/1972 Boyriven ..... 49/28
4,530,185 A * 7/1985 Moriya et al. ..... 49/280
4,665,710 A * 5/1987 Kyzer et al. ..... 62/155
5,018,303 A * 5/1991 Koura et al. ..... 49/280
5,155,937 A * 10/1992 Yamagishi et al. ..... 49/280
5,632,120 A * 5/1997 Shigematsu et al. ..... 49/280 X
5,640,807 A * 6/1997 Shigematsu et al. ..... 49/280 X
5,832,669 A * 11/1998 Mizuki et al. ..... 49/280 X

OTHER PUBLICATIONS

An article published by Toyota Co. Ltd., Aug. 1995, pp. 53–62.

* cited by examiner

*Primary Examiner*—Jerry Redman
(74) *Attorney, Agent, or Firm*—Burns, Doane, Swecker & Mathis, LLP

(57) ABSTRACT

A door control device is adapted to smoothly shift the mode of operation to the door closer operation at the time the door is being moved by pushing in the door closing condition, without requiring a large size motor and without the need for increasing the strength of the drive medium. The door control device includes a closer for shifting a slide door from the half door condition to the fully closed condition, and a clutch mechanism which is interposed in a power transmission system between the slide door and a motor for driving the slide door. If the slide door is electrically driven, a clutch of the clutch mechanism is rendered operational to move the slide door and the closer operation is started after the sliding operation. The door control device further includes a pole switch which detects the condition of the slide door and a junction switch which establishes the connection when the condition of the slide door is between a condition right before the half door condition and the fully closed condition, and effects the supply of electricity to the closer. If the junction switch is connected in the midst of the closing operation of the slide door, the closer operation is started and then the motor is stopped when the slide door is moved a given distance.

13 Claims, 12 Drawing Sheets

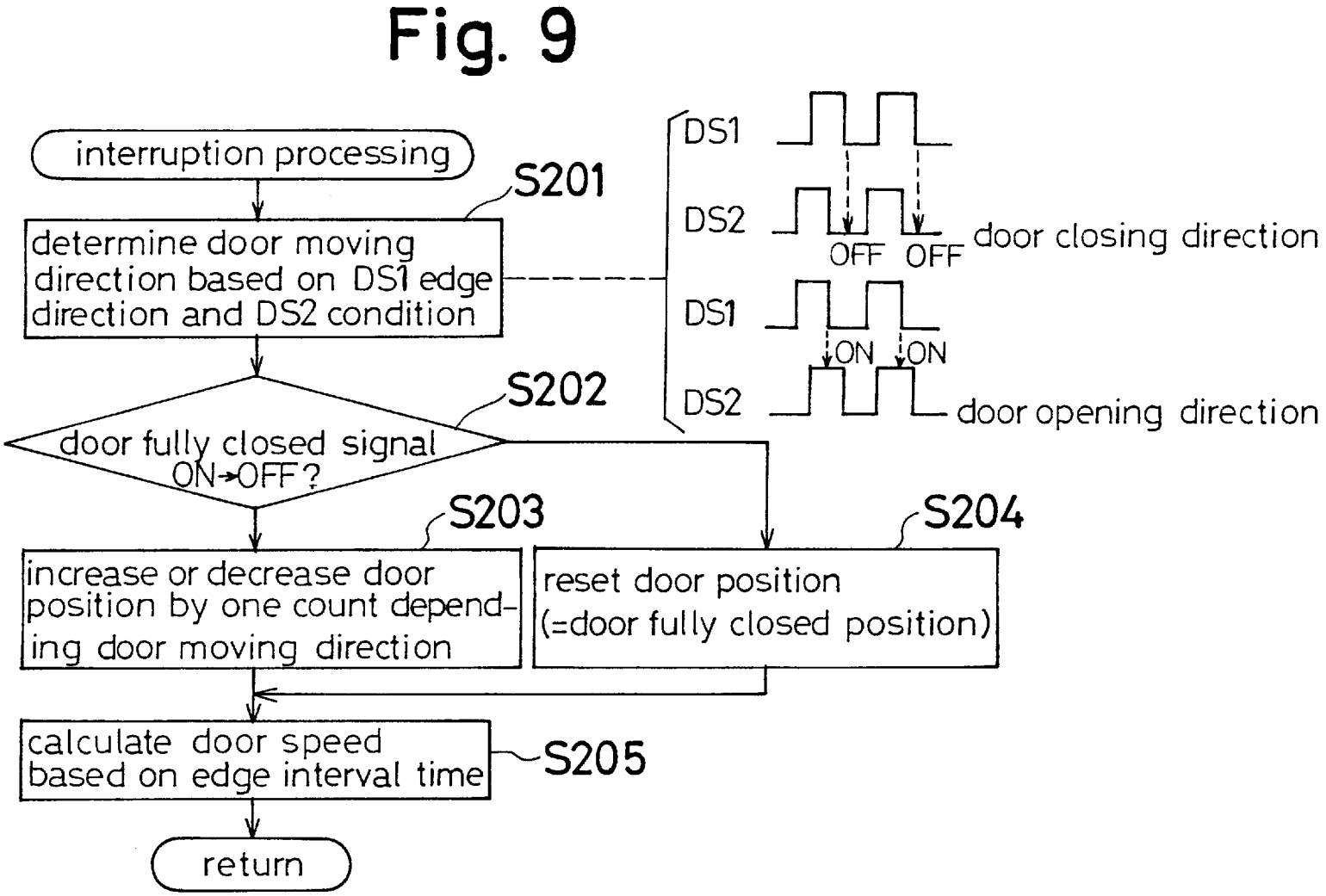
Fig. 9
interruption processing
S201
determine door moving direction based on DS1 edge direction and DS2 condition
DS1
DS2
OFF
OFF
door closing direction
DS1
DS2
ON
ON
door opening direction
S202
door fully closed signal ON→OFF?
S203
increase or decrease door position by one count depending door moving direction
S204
reset door position (=door fully closed position)
S205
calculate door speed based on edge interval time
return

Fig. 14
(a)
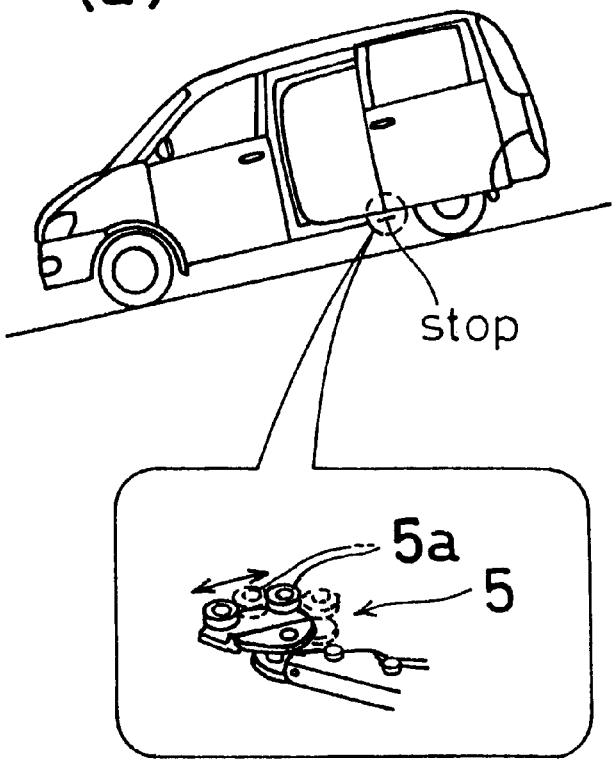
(b)
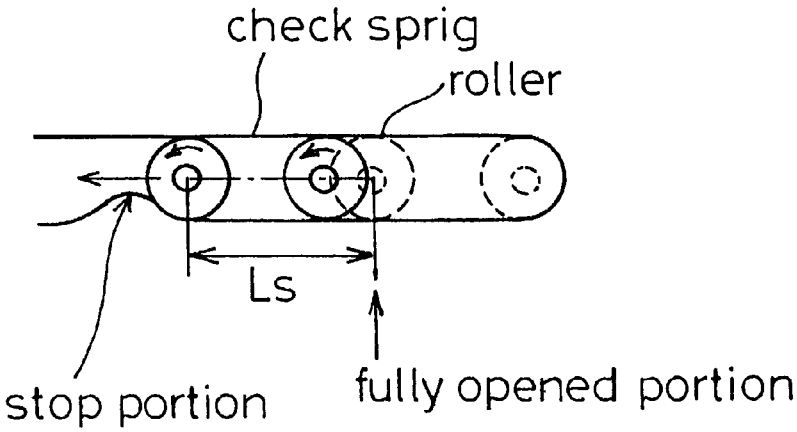

DOOR CONTROL EQUIPMENT

This application is based on and claims priority under 35 U.S.C. §119 with respect to Japanese Application No. 10(1998)-340536 filed on Nov. 30, 1998, the entire content of which is incorporated herein by reference.

FIELD OF THE INVENTION

The present invention generally relates to door control equipment. More particularly, the present invention pertains to door control equipment for controlling operation of a vehicle slide door.

BACKGROUND OF THE INVENTION

Recently, van-type vehicles have been provided with a slide door mounted on the rear portion of the vehicle for movement between opening and closing positions. The vehicle can be provided with a door condition detecting switch which detects whether the slide door is in the half door or half latched condition or the fully closed condition. When the door reaches the half door condition, the door condition detection switch detects this half door condition and outputs a signal to an electricity supply relay (a slide door control relay) for electrically driving the slide door. Here, the slide door control relay rotates a full lock motor and a slide door easy closer (hereinafter called a closer) which shifts the condition of the slide door from the half latch condition to the fully closed condition automatically. A manipulation switch is also mounted on the vehicle side. By manipulating the manipulating switch, the slide door is electrically driven and is automatically opened and closed. Such a slide door is referred to as an electrically operated slide door and is disclosed on pages 53–62 of a manual for a new type car called Granvia (published by Toyota Co., Ltd., In August 1995).

In this electrically operated slide door, to change over between the manual operation and the automatic driving operation of the slide door, a clutch mechanism for connecting or interrupting the power transmission path is interposed in the power transmission system between the slide door motor and the slide door. When the slide door is electrically driven, the clutch of the clutch mechanism is connected. In such a device, the power of the slide door motor is transmitted to a magnetic clutch, a roller pulley and a rubber roller by way of a motor belt and upon rotation of the rubber roller, the slide door is moved and slides along the guide rails mounted on a side body of the vehicle.

In shifting the operation from the slide operation to the closer operation by the electrically operated driving of the slide door, the slide door condition (i.e., whether the slide door is in the fully closed or full latch condition or whether the door is in the half door or half latch condition) is detected and the slide door is then moved in a closing direction to the half latch condition by the slide movement. A signal indicating the half latch condition is used as a trigger to turn off the slide motor provided for the slide operation. Thereafter, the closer is operated to completely close the slide door by the closer operation.

However, in case the slide door is moved to the half latch condition or half door condition with the power of the motor for driving the slide door, when the slide motor is operated and its power is decelerated by the drive mechanism and the large slide door is to be moved, it is necessary to move the slide door to the half latch position. Therefore, in case the slide door is moved by pushing by means of the drive mechanism, a motor having a large torque becomes necessary, thus requiring a relatively large and expensive motor.

In addition, at the time of closing the slide door, it is necessary to push the slide door against the repulsive or opposing force caused by the deflection of the weather strip provided at the periphery of the slide door for preventing the intrusion of wind and rain into the inside of the vehicle. Thus, when the slide door is pushed into a position close to the fully closed position, the driving force is correspondingly increased by this force so that the slide door must be structurally stronger.

In light of the foregoing, a need exists for a door control mechanism that provides a smooth shifting of operation from the slide operation to the closer operation during the door closing operation without increasing the size of the motor. A need also exists for a door control mechanism that provides a smooth shifting of operation from the slide operation to the closer operation during the door closing operation without the need for strengthening the drive medium of the door as compared to conventional equipment.

SUMMARY OF THE INVENTION

According to one aspect of the invention, a door control device for controlling movement operation of a door includes a motor, a clutch mechanism interposed between the door and the motor for transmitting output from the motor under driving operation to the door to move the door, a closer operable under a closer operation for shifting the door from a half door condition to a fully closed condition, a connecting mechanism for establishing a connection to supply electricity to the closer from right before the half door condition to the fully closed condition, and a door condition detector for detecting whether the door is in the half door condition or in the fully closed condition based on output from the connecting mechanism. When a connection signal is outputted during a door closing operation of the door, the closer operation is started and upon the door being moved a given distance, the driving operation of the motor connected to the clutch mechanism is stopped.

By virtue of this construction, if the connection signal is outputted from the connection mechanism which establishes the connection from right before the half door condition to the fully closed condition, the closer operation is started so that the door drive operation due to the clutch connection and the closer operation can be overlapped. Hence, when the connection signal is outputted from the connection mechanism and the motor is stopped when the door is moved a given distance, the closer can be operated from right before the half door condition.

For example, in the case of a slide door of a vehicle in which the slide door is moved by pushing by way of a drive mechanism ,the deflection of the weather strip can be held small in this condition so that the repulsive force also can be made small. Accordingly, the force necessary for moving the slide door can be reduced by the pushing force against the repulsive force of the weather strip. Furthermore, since it is no longer necessary to move the slide door to the half door condition by the slide operation, the motor which moves the slide door by pushing can be made relatively small in size compared to the motor used in other known devices of this type.

When the output of the door condition detection mechanism indicates the half door condition, the clutch connection of the clutch mechanism is interrupted, and when the door is moved to the fully closed condition, the closer operation is stopped so that the door can be transferred to the closer as fast as possible, so that the motor connected with the clutch mechanism can be stopped earlier, and so that the shifting of operation from the slide operation to the closer operation can be smoothly performed, thus enabling the miniaturization of the motor and the lowering of the required electric current. Furthermore, it is unnecessary to make the drive mechanism as strong as is the case with other known drive mechanisms.

According to another aspect of the invention, a door control device for controlling movement operation of a door includes a slide door mounted on a lateral side of a vehicle body for movement in a lengthwise direction of the vehicle body between a fully open position and a fully closed position, a drive device operatively associated with the slide door, a clutch mechanism for alternatively establishing and interrupting a coupling between the slide door and the drive device, a closer operable under a closer operation for shifting the sliding door from a half latch condition to a fully latched condition, and a mechanism for establishing a connection to supply electricity to the closer from right before the half latched condition to the fully latched condition and for outputting a connection signal. A door condition detector detects whether the sliding door is in the half latched condition, whereby upon output of the connection signal during a slide door closing operation, the closer operation is started and upon movement of the sliding door by a predetermined distance, operation of the driving device is stopped.

In accordance with another aspect of the invention, a door control device for controlling movement operation of a door includes a slide door mounted on a lateral side of a vehicle body for movement in a lengthwise direction of the vehicle body between a fully open position and a fully closed position, a drive device operatively associated with the slide door, a clutch mechanism for alternatively establishing and interrupting a coupling between the slide door and the drive device, a closer operable under a closer operation for shifting the sliding door from a half latch condition to a fully latched condition, and a mechanism for establishing a connection to supply electricity to the closer from right before the half latched condition to the fully latched condition and for outputting a connection signal. A door condition detector outputs signals indicating that the sliding door is in the half latched condition and the full latched condition so that upon output of the signal from the door condition detector indicating the half latched condition of the slide door, the closer operation of the closer occurs and a clutch connection between the clutch mechanism and the driving device is interrupted, and upon output of the signal from the door condition detector indicating the fully latched condition of the slide door, the closer operation is stopped.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein:

FIG. 9 is a flow chart showing the interruption processing carried out by the controller shown in FIG. 7;

FIG. 11(*b*) is a timing chart showing the conditions of the various switches inputted to the controller and the output signals from the controller during a door closing operation by a manipulation switch;

FIG. 14(*a*) is a perspective view of a vehicle showing in detail the construction of the roller unit which moves the slide door along a guide rail; and FIG. 14(*b*) is a detailed view of the relationship between the rollers of the roller unit and the check spring which stops the rollers in a given place.

DETAILED DESCRIPTION OF THE INVENTION

Figure 1:
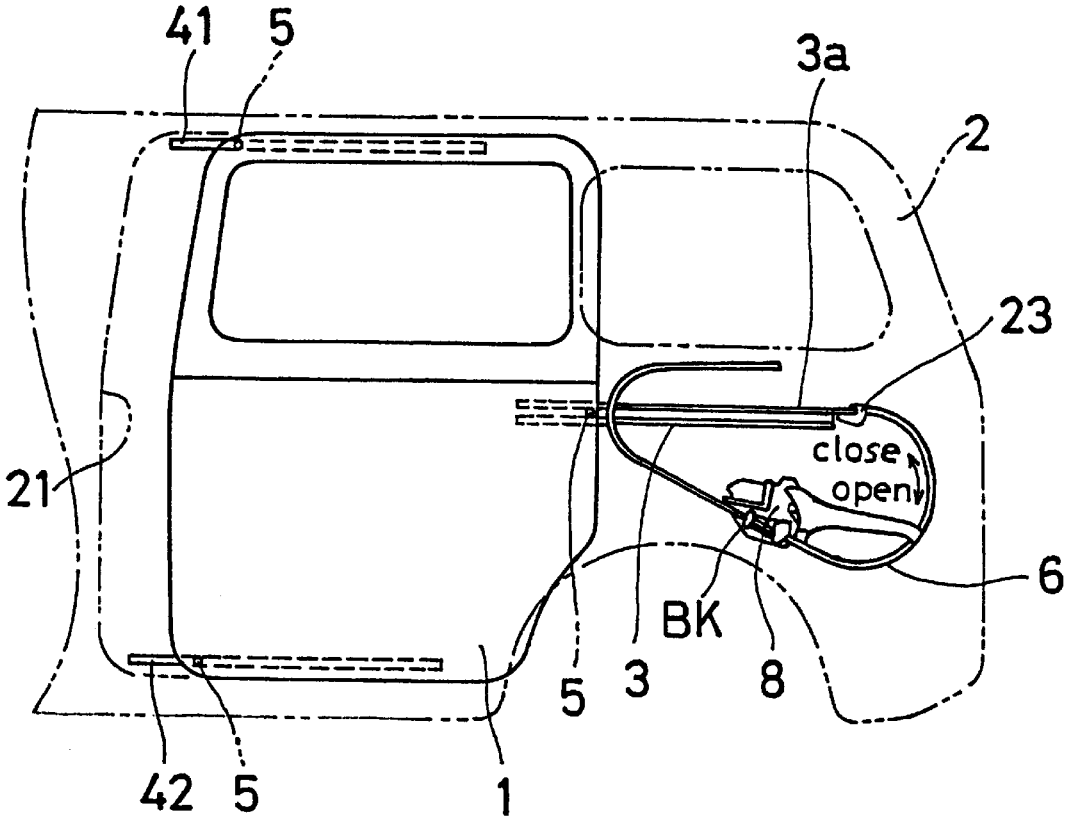
FIG. 1 is a side view of a vehicle illustrating a sliding door controlled by the door control device according to one embodiment of the present invention.

As shown in FIG. 1, a slide door 1 is provided for opening and closing a generally rectangular door opening 21 formed in the side body 2 of a vehicle. The slide door 1 is slidably supported in the vehicle traveling direction (i.e., in the left-and-right direction in FIG. 1) by way of a center guide rail 3, an upper guide rail 41 and a lower guide rail 42, all of which extend in the vehicle traveling direction.

The upper guide rail 41 is disposed along and in the vicinity of the upper edge portion of the door opening 21 and is fixedly secured to the side body 2 of the vehicle. Similarly, the lower guide rail 42 is disposed along and in the vicinity of the lower edge portion of the door opening 21 and is fixedly secured to the side body 2 of the vehicle. The center guide rail 3 is fixedly secured to the central portion of the outer surface of the side body 2 extending from the door opening 21 toward the rear portion of the vehicle.

Three sets of guide roller units 5 are mounted on the slide door 1, with each guide roller unit 5 being slidably guided by a respective one of the guide rails 3, 41, 42. The slide door 1 opens or closes the door opening 21 by sliding movement, wherein the rollers 5*a* forming the guide roller units 5 are slidably mounted in the inside of the guide rails 3, 41, 42 and are thus guided by the guide rails 3, 41, 42. The guide rails 3, 41, 42 are disposed in parallel with each other and extend in the traveling direction of the vehicle. The front ends of the guide rails 3, 41, 42 are bent toward the inside of the vehicle for guiding the slide door 1 in a manner which causes the outer surface of the slide door 1 to be coplanar with the outside surface of the side body 2 when the slide door is moved to the closed position. When the door opening 21 is closed by operating the slide door 1, the outer surface of the slide door 1 and the surface of the side body 2 of the rear portion of the vehicle are thus aligned with each other.

Figure 5:
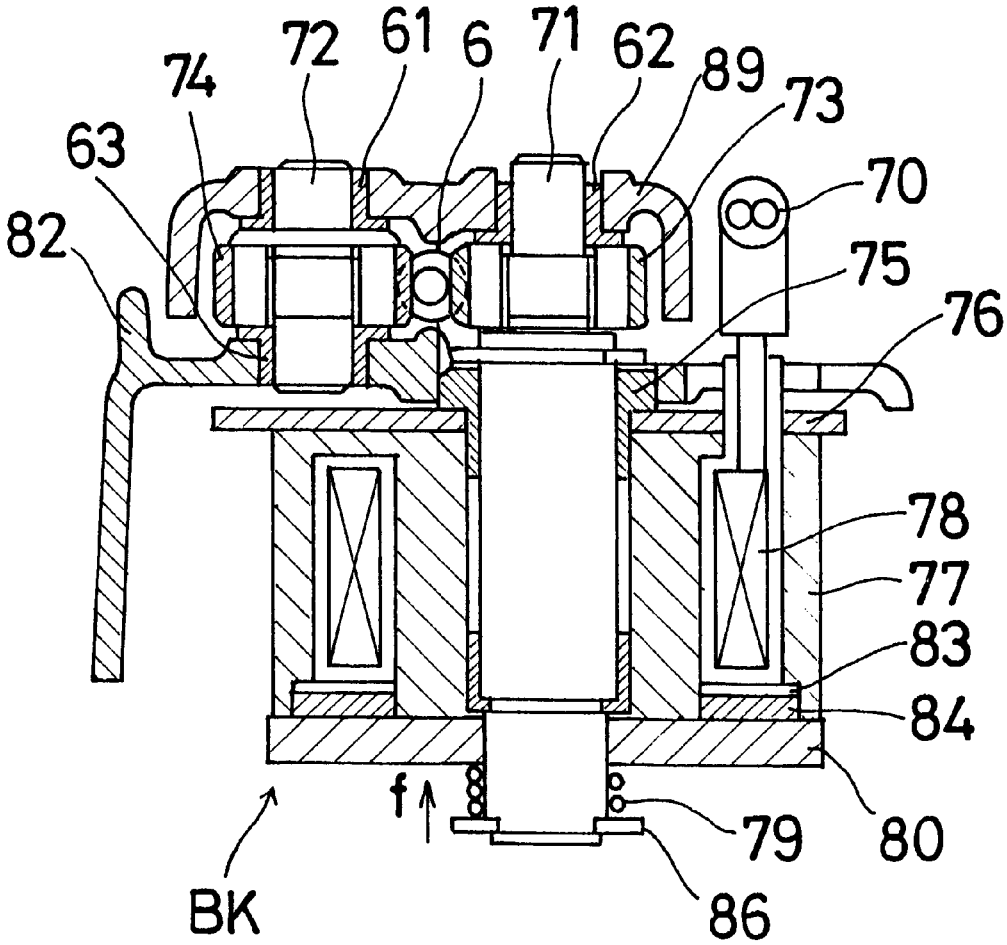
FIG. 5 is a cross sectional view of the drive mechanism shown in FIG. 2 taken along the section line V—V.
Figure 6:
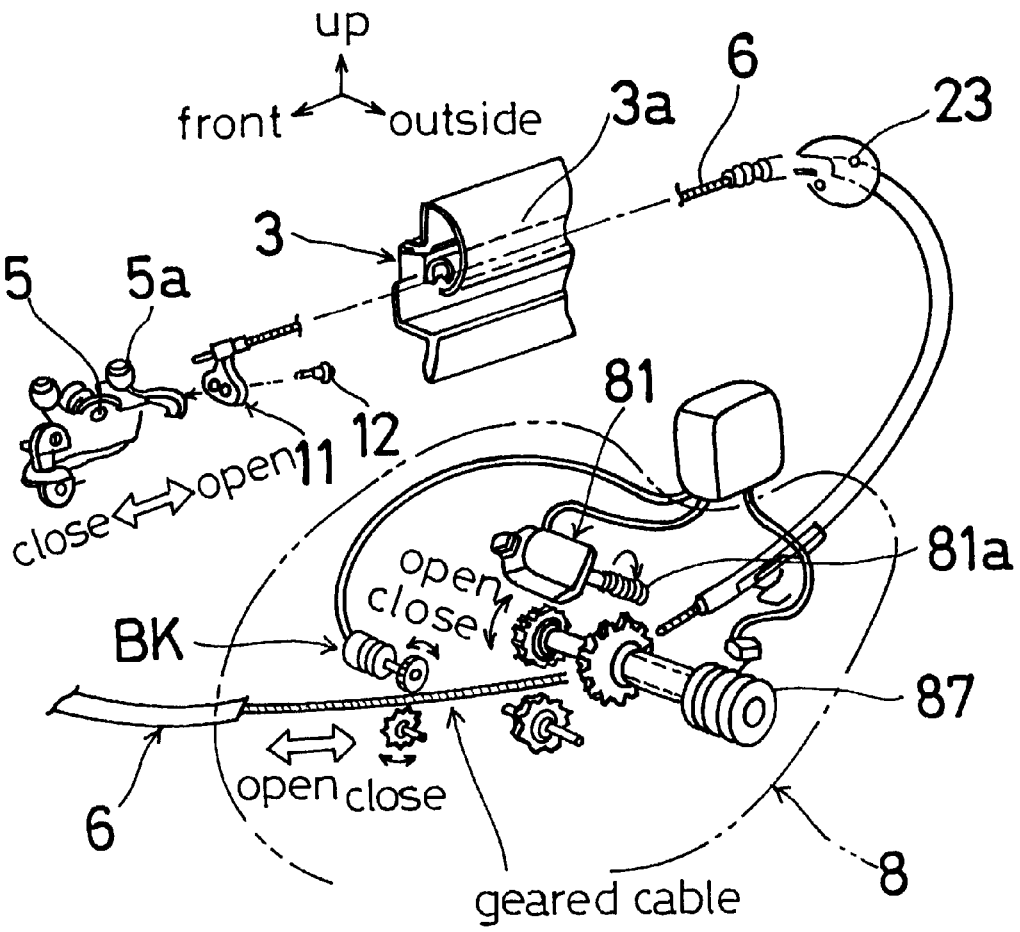
FIG. 6 is a perspective view of the power transmission system extending between the slide door and the motor of the drive mechanism shown in FIG. 2.

FIGS. 1–6 illustrate the mechanism for effecting sliding movement of the slide door 1. The slide door 1 is connected to a geared cable 6 by way of a shoe 11 which is fixedly fastened by a pin to the roller unit 5 which in turn is mounted on the rear portion of the slide door 1. This geared cable 6 is introduced into the inside of the vehicle by way of a grommet 23 which is mounted on the rear portion of the center guide rail 3. The geared cable 6 is pushed and pulled by way of a drive mechanism or actuator 8 that is fixedly secured to the indoor side of the side body 2 of the vehicle to slide the geared cable 6 in the inside of a guide pipe 3*a* formed in the center guide rail 3 as shown in FIG. 6. As a result, the roller units 5 roll on in the inside of the respective guide rails 3, 41, 42 to thereby open and close the slide door 1.

As shown in FIGS. 2–5, the drive mechanism 8 for opening and closing the slide door 1 is mounted, by way of a mounting bracket 85, on the inside of the indoor panel of the side body 2 of the vehicle by a fixing mechanism such as screws. A reduction gear mechanism is disposed in the inside of the housing 82 of the drive mechanism 8 and a direct current motor 81 for driving the reduction mechanism is mounted on and fixedly secured to the housing 82.

When the direct current motor 81 is energized by way of an external harness, electricity is supplied to a coil in the motor so that the motor 81 is rotatably driven. The motor includes an output shaft provided with a worm 81*a*. The rotation of the motor 81 is thus transmitted to a worm wheel (not shown) which meshes with the worm 81*a*. The worm wheel is mounted in the inside of the housing 82 for reducing the speed of the rotation of the motor 81 and the rotational output is transmitted to an output shaft 87 pivotally mounted on a cover 89 that is mounted on the housing 82. A serration is formed on this output shaft 87 and an output gear 83 which is provided with a serration in an inner central portion thereof is disposed in meshing engagement with the serration of the output shaft 87. Upon rotation of the output shaft 87, the output gear 83 is integrally rotated with the output shaft 87. Upon rotation of this output gear 83, the geared cable 6 is pushed or pulled (being pulled when the output shaft 87 is rotated in a clockwise direction as shown in FIG. 6 in an opening operation and being pushed when the output shaft 87 is rotated in a counterclockwise direction as shown in FIG. 6 in a closing operation) to carry out the opening and closing operation of the slide door 1. The geared cable 6 which pushes or pulls the slide door 1 is meshed with a driven gear 84 mounted on a driven shaft 88 which in turn is mounted on the housing 89 on which the output gear 83 is also rotatably mounted. The geared cable 6 is thus sandwiched by the output gear 83 and the driven gear 84 so that the geared cable 6 reliably meshes with both gears 83, 84.

A clutch mechanism CL is mounted on the output shaft 87 in an axial direction. The output shaft 87 is rotatably supported by bearings 90, 91 located in the housing 82. The output shaft 87 is provided with a serration at two portions (upper and lower portions). A rotor 98 and the output gear 83 are mounted on these portions of the shaft 87. The rotor 98 and the output gear 83 have teeth that mesh with these serrated portions of the output shaft 87.

The bearing 91 is positioned in the central portion of an annular core 99 which is accommodated in the case 82. The core 99 is provided with a central opening that receives the bearing 91. The outer peripheral portion of the core 99 is provided with a circumferential recessed portion. A circular coil 80 is disposed in this circumferential recessed portion in a circumferentially wound manner. The coil 80 receives electricity from outside by way of a harness and is coaxially arranged with the output shaft 87. Furthermore, a rotor 98 is disposed coaxial with the core 99 in such a manner that the rotor 98 closes the open side of the circumferential recessed portion of the core 99. A ring-like magnet 97 is fixedly secured to the rotor 98 such that the outer periphery of the magnet 97 has the same diameter as that of the rotor 98. The magnet 97 is fixedly secured to the rotor 98 such that eighty sets of N/S poles are respectively alternately magnetized on the outer periphery thereof. The motor 98 and the magnet 97 are integrally rotated upon rotation of the output shaft 87. Two rotating position detection sensors 43, 44 having Hall elements which change over signals in response to the N/S polarities formed on the magnet 97 and disposed in opposition to the magnet 97 are arranged in a circumferential direction. These sensors output waveforms whose phases are shifted 90° from each other. These sensors function as sensors for detecting the rotating condition of the motor 81, that is the degree of opening of the slide door 1 by the rotation of the motor. Accordingly, these sensors 43, 44 are referred to here as door sensors. The signals obtained by these sensors are outputted to the outside by way of the harness shown in FIG. 4.

Figure 3:
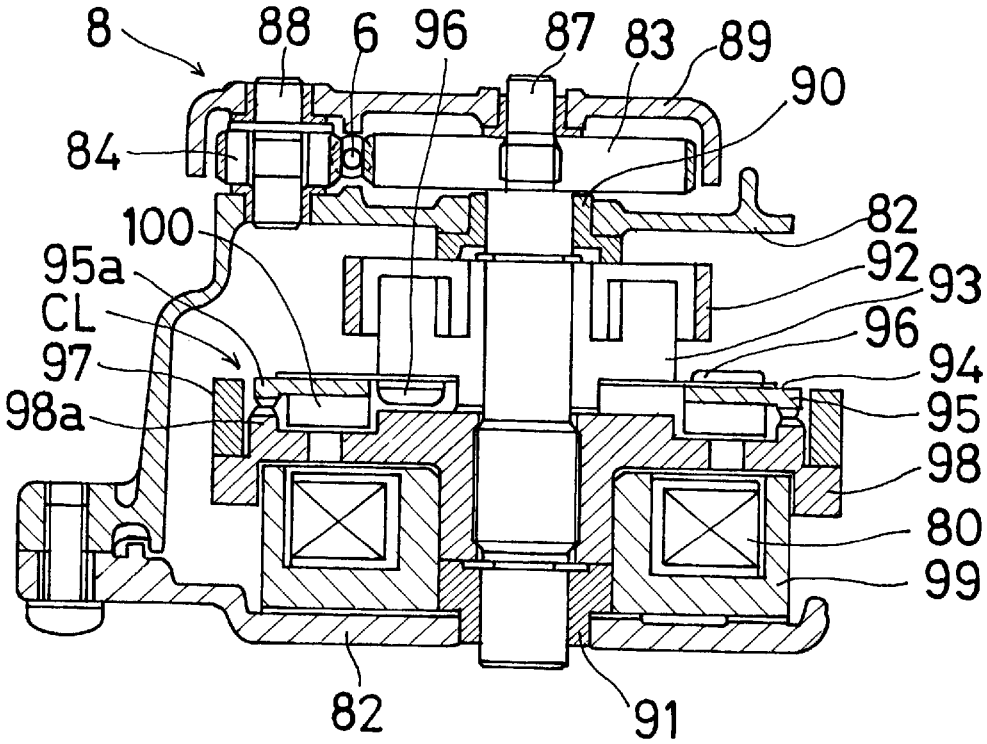
FIG. 3 is a cross sectional view of the drive mechanism shown in FIG. 2 taken along the section line III—III.
Figure 4:
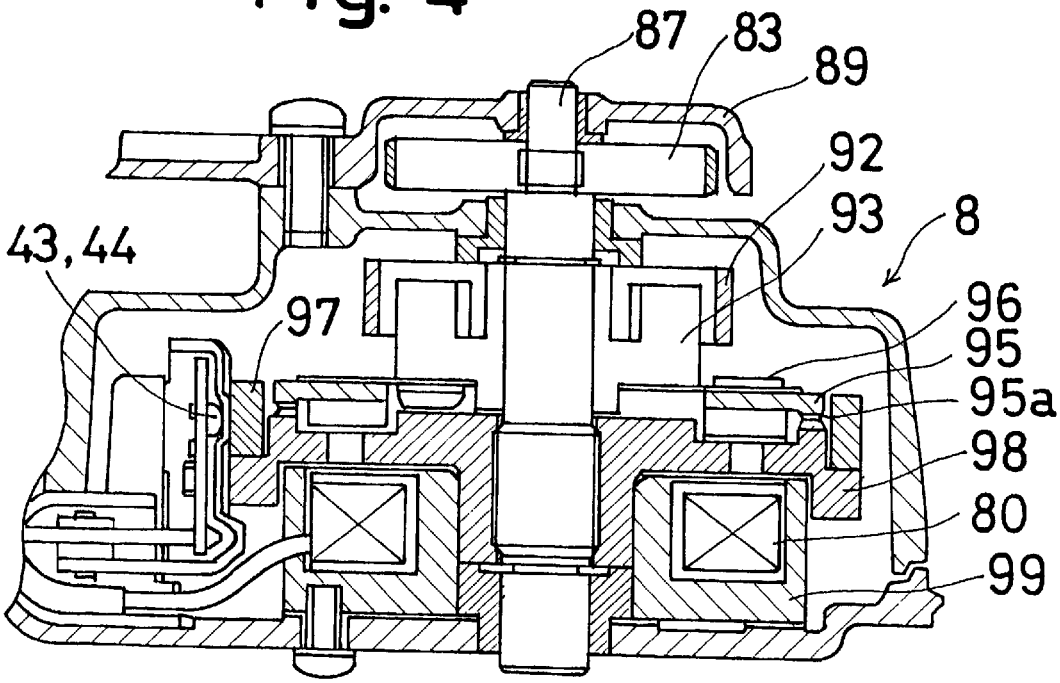
FIG. 4 is a cross sectional view of the drive mechanism shown in FIG. 2 taken along the IV—IV.

The rotor 98 is made of magnetic material and a circumferential protrusion 98*a* is formed on the rotor 98 at the inner diameter side of the magnet 97. The protrusion 98*a* formed on the rotor 98 and a protrusion 95*a* formed on a ring member 95 are arranged in opposing relation to one another as shown in FIG. 3 so that they face each other with a given gap in the axial direction.

An annular armature 100 made of magnetic material which strengthens the electromagnetic force at the time of generating the electromagnetic force is fixedly secured to the ring member 95 at the inner diameter side of the protrusion 95*a* of the ring member 95. By supplying electricity to the coil 80 disposed in the core, a magnetic closed loop is formed between the core 80, the rotor 98 and the armature 100. As a result of this electromagnetic force, the protrusion 98*a* of the rotor 98 and the protrusion 95*a* of the ring member 95 are attracted to each other in an axial direction, and the rotor 98 and the ring member 95 are thus integrally rotated by virtue of meshing engagement of geared portions. The core 99, the coil 80, the rotor 98, the armature 100 and the ring member 95 function as an electromagnetic clutch CL.

On the surface of the ring member 95 that is opposite to the surface on which the protrusion 95*a*, a hub 93 is provided by way of a flat spring 94. The ring member 95 and the hub 93 are fixedly connected with each other by way of rivets 96. To be more specific, the ring member 95 and the hub 93 are integrally formed by caulking the ring member 95 (and the armature 100) with the rivets 96 by way of the flat spring 94 and then caulking the hub 93 by way of the flat spring 94, whereby the hub 93 is rotated together with the ring member 95.

A gear 92 is fitted into the hub 93 by way of a damper. Upon rotation of the motor 81, the impact caused by the rotation of the worm wheel is absorbed by the damper and is received by the gear 92.

To open or close the slide door 1 using electric power, the coil 80 is first energized. When electricity is supplied to the coil 80 from the outside, the magnetic closed loop is formed among the core 80, the rotor 98 and the armature 100. The protrusion 98*a* of the rotor 98 and the protrusion 95*a* of the ring member 95 are attracted to each other in an axial direction by the electromotive force and the electromagnetic clutch CL is switched to the ON condition so that the rotor 98 and the ring member 95 are integrally rotated, for example by virtue of meshing gear portions. By electrically setting the clutch to the ON condition where the protrusion 98*a* of the rotor 98 and the protrusion 95*a* of the ring member 95 are attracted to each other due to the electromagnetic force to thus form an integrally moving body, the motor 81 is driven. The rotation of the motor 81 is transmitted to the worm wheel of the reduction mechanism by way of the worm 81*a* mounted on the motor output shaft. The rotation of the worm wheel is received by the outer teeth of the gear 92 while the impact is absorbed by the damper interposed between the hub 93 and the gear 92. Because the clutch is held in the ON condition, the rotation is transmitted to the rotor 98 by way of the ring member 95 which is rotated integrally with the gear 92. The force transmitted to the rotor 98 rotates the output shaft 87. As a result, the output gear 83 which is integrally rotatable with the output shaft 87 is rotated. Upon rotation of this output gear 83, along with the driven gear 84 disposed at the opposite side of the geared cable 6, the geared cable 6 is operated in the condition that the geared cable 6 is assuredly meshed with the output gear 83 and the driven gear 84 thus opening or closing the slide door 1.

When the slide door 1 is opened or closed by manual operation, electricity is not supplied to the coil 80 and the motor 81 and so the clutch CL is turned off because a gap exists between the protrusion 98*a* of the rotor 98 and the protrusion 95*a* of the ring member 95 so that the mechanical connection of the power transmission system is not established. Although the output gear 83 and the rotor 98 are rotated by the manual manipulation of the slide door 1, the power transmission passage connected to the motor 81 is cut off so that the slide door 1 can be manually opened or closed.

Figure 2:
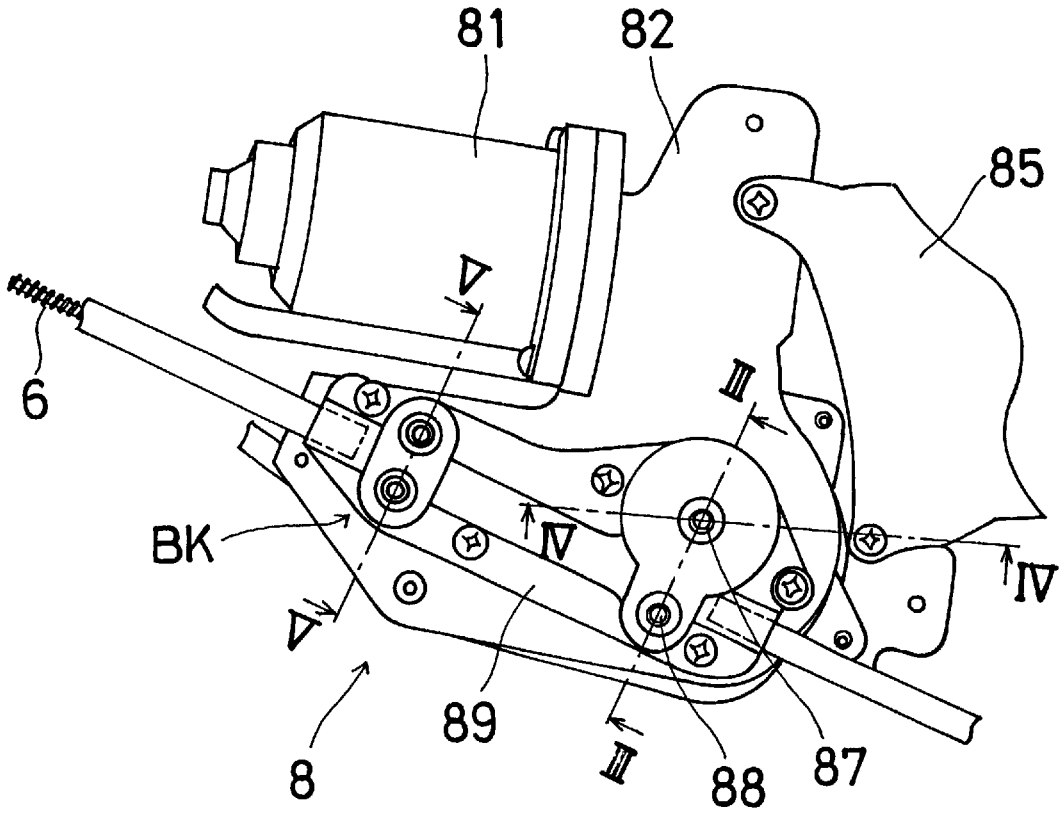
FIG. 2 is an enlarged view of a portion of the drive mechanism shown in FIG. 1.

A brake mechanism BK is attached to the drive mechanism 8 as shown in FIG. 2. This brake mechanism BK is mounted where the geared cable 6 is moved and restricts the movement of the geared cable 6 to apply a brake to the moving geared cable 6 in case the slide door 1 is not electrically operated.

As shown in FIG. 5, a brake gear 73 which is mounted on a brake shaft 71 and a driven gear 74 which is mounted on a driven shaft 72 of the brake mechanism BK mesh with the geared cable 6 from opposite sides. The brake gear 73 is mounted on the brake shaft 71 and the driven gear 74 is mounted on the driven shaft 72 by way of respective serration connections so that they are integrally rotated with the brake shaft 71 and the driven shaft 72 respectively. Further, both gears 73, 74 are pivotally or rotatably supported by respective bearings 61, 62 mounted on the cover 89 and respective bearings 63, 75 mounted on the housing 82 such that they are rotatable.

The intermediate portion of the brake shaft 71 is provided with a flanged portion and this flanged portion comes into contact with an axial end face of the bearing 75 by way of a washer so as to restrict the movement of the brake shaft 71 in one direction. The bearing 75, which pivotally supports the brake shaft 71, is received in a bracket 76 which is fixedly secured to the housing 82. A core 77 made of a cylindrical magnet or magnetic body is fixedly secured to one side face of the bracket 76 by welding or the like. The bracket 77 is provided with a recessed portion in the inside thereof and a coil 78 is accommodated in the recessed portion. On the inside of the recessed portion where the coil 78 of the core 77 is accommodated, a shoulder portion is formed. On this shoulder portion, an annular metal plate 83 made of stainless steel (SUS) and a friction plate 84 underlying the metal plate 83 are disposed to close the opening where the coil 78 is disposed. As seen in FIG. 5, the metal plate 83 and the friction plate 84 are disposed on the shoulder portion in such a way that the friction plate 84 slightly protrudes from one end face of the core 77. The end of the recessed portion of the core 77 where the friction plate 84 is provided is covered by a disc-like armature 80 made of a magnetism body. The armature 80 is mounted on the brake shaft 71 coaxially with the core 77. This armature 80 and the brake shaft 71 are engaged with each other by way of the serration connection so that when the brake shaft 71 is rotated due to the meshing engagement of the brake gear brake 73 with geared cable 6 during movement of the geared cable 6, the armature 80 and the brake shaft 71 are integrally rotated. Because the driven gear 74 is disposed at the opposite side of the brake gear 73 with respect to the geared cable 6, the geared cable 6 is assuredly meshed with the brake gear 73 and the driven gear 74.

A spring 79 is mounted on the outer periphery of the brake shaft 71 for biasing the armature 80 to the friction plate 84. While holding the spring 79 in a compressed form, a ring member 86 is fitted into a groove portion formed on the brake shaft 71 in the vicinity of the end portion of the brake shaft 71. Because the movement (removal) of the brake shaft 71 in one direction is stopped by the flange portion, the armature 80 is pushed to the core side by the biasing force of the spring 79 such that the armature 80 comes into contact with the friction plate 84.

When the coil 78 is energized from the outside by way of a harness 70 so that electricity is supplied to the coil 78, a closed loop magnetic circuit is established between the coil 78, the core 77 and the armature 80. Due to the electromagnetic force, the armature 80 is attracted to the friction plate 84 side. This restricts the relative rotation which is generated between the non-rotational core 77 and the armature 80 which is integrally rotated with the brake shaft 71 when the geared cable 6 is moved. That is, a braking force is applied to the brake shaft 71 by the operation of an electromagnetic clutch (brake clutch) BK constituted by the coil 78, the core 77 and the armature 80 so that the brake shaft 71 rotation is restricted. By restricting the rotation of the brake shaft 71 which is integrally rotated with the armature 80 based on the amperage which flows in the coil 78 and the energizing time, the rotation of the brake gear 73 is restricted. As a result, the movement of the geared cable 6 which meshes with the brake gear 73 is also restricted so that the brake force is applied to the geared cable 6.

Considering the above explanation of the clutch mechanism CL and the brake mechanism BK of the drive mechanism 8 for opening and closing the slide door 1, the manner of operation of the slide door 1 is explained below. By manipulating or pushing the manipulation switch disposed in the vicinity of the driver's seat, the slide door 1 (the electrically operated slide door) can be fully opened or fully closed automatically for performing the electrical operation with the switch operation. On the other hand, when the slide door 1 is slightly opened in a manual manner from the fully closed condition or is slightly closed in a manual manner from the fully opened condition, the slide door 1 is automatically opened or closed. To be more specific, in the opening operation, provided that a cancel switch 4*a* (switch which prohibits the slide control) is turned off, when the manipulation switch "OPEN" (the manipulation switch may be a two stage OFF/OFF switch) is pushed, the latch of the slide door 1 is automatically released in case the slide door 1 is latched. So long as the pushing of the manipulation switch is continued, the slide door 1 is automatically operated until it reaches the fully opened position. On the other hand, provided that a cancel switch 4*a* is turned off, so long as the pushing of the manipulation switch "CLOSED" is continued, the slide door 1 is automatically operated in a closing direction and on the point of being fully closed, a closer CZ is operated so as to fully close the slide door 1.

Furthermore, provided that the cancel switch 4*a* is turned off, when the slide door 1 is manually operated from the fully closed position to the fully opened position, and provided that the cancel switch 4*a* is turned off, the slide door 1 is manually closed from the fully opened position or the slide door 1 is automatically closed when the door handle is pulled.

In case the supply of electricity to the drive transmission system of the slide door 1 is cut off to set the slide door 1 in a free condition (condition that the clutch of the drive mechanism for electrically operating the slide door 1 is turned off so that the slide door 1 can be moved freely by manual manipulation) and the vehicle is in an inclined condition such as being placed on a descending slope or the like, the slide door 1 is liable to start moving due to its own weight and thus may pinch a passenger by this moving slide door 1. To prevent such an accident, the brake mechanism BK which prevents the slide door 1 from exceeding a given speed is provided.

Figure 7:
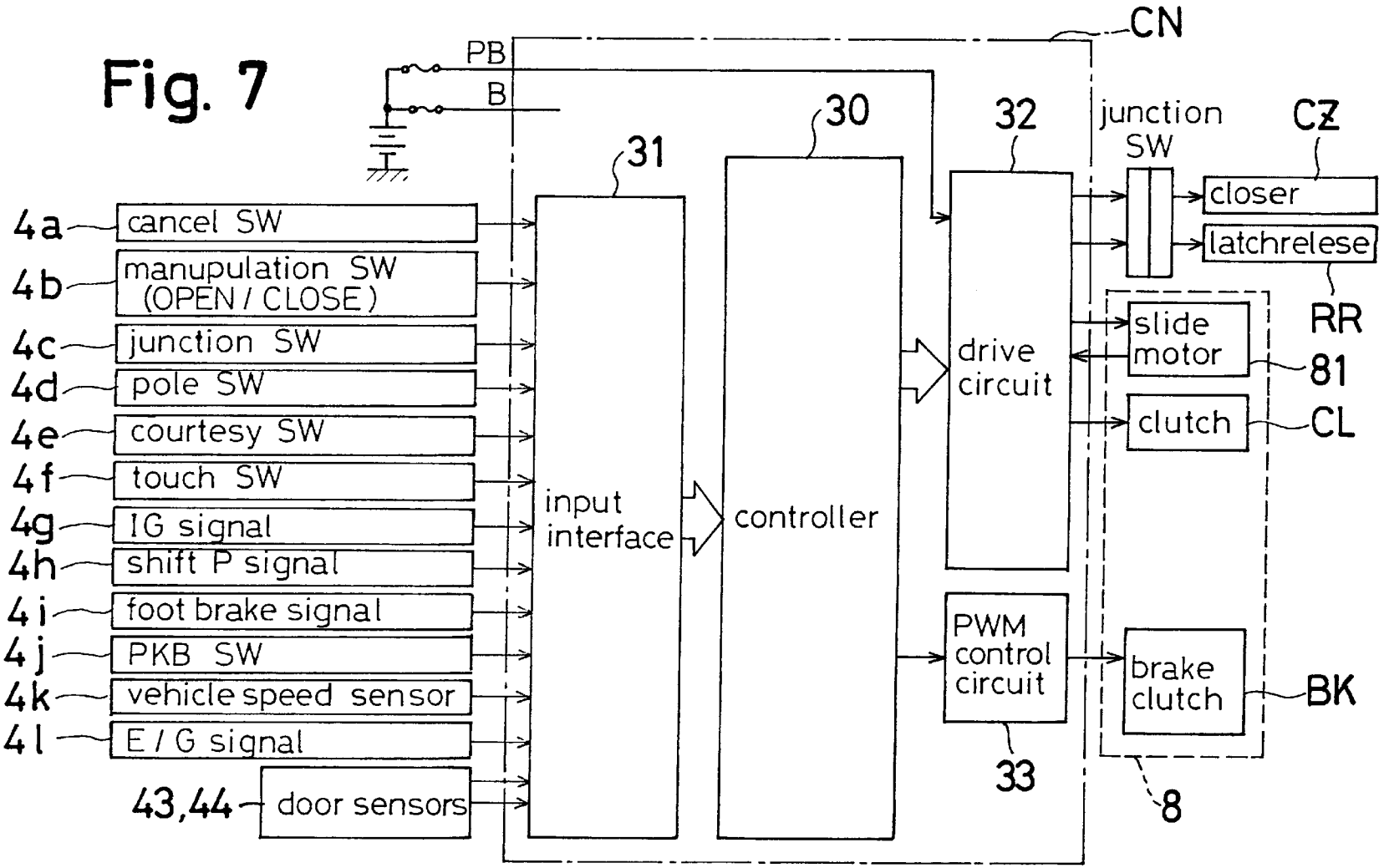
FIG. 7 is a block diagram showing the internal construction and external connections of the controller used in the present invention.

The external connection of the control unit CN provided with a pinching prevention function is explained in connection with FIG. 7. Upon receiving signals from various switches and sensors by way of an input interface 31, a controller 30 executes the open/close control of the slide door 1 in response to these signals. The drive mechanism 8 which drives the slide door 1 is driven by a drive circuit 32 in response to the output signal from the controller 30 so as to push or pull the geared cable 6, thus opening or closing the slide door 1. The brake clutch BK which restricts the movement of the geared cable 6 is controlled by a PWM control circuit 33.

Referring to the switches and sensors which detect the conditions of the vehicle, the cancel switch 4*a* is a switch which cancels the power slide control when it is turned on, a manipulation switch 4*b* is a switch which automatically opens the slide door 1 when the door OPEN is pushed and automatically closes the slide door 1 when the door CLOSE is pushed. A pole switch 4*d* is a switch which is incorporated in the inside of an actuator of the door closer CZ and detects whether the condition of the slide door 1 is at a half latch condition (half door condition where the sliding door is in an incompletely latched condition) or is at a full latch condition (fully closed condition where the sliding door is in a fully latched condition). A courtesy switch 4*e* is a switch which detects that the slide door 1 is in the opened condition when it is turned on and detects that the slide door 1 is in the closed condition when it is turned off. A touch switch 4*f* is a switch which is disposed at a position where the slide door 1 is closed and detects whether the touch switch is pushed or the disconnection occurs. A PKB (parking brake) switch 4*j* is a switch which detects whether or not the parking brake is pulled. A junction switch 4*c* is a switch which supplies electricity to the closer CZ mounted on the slide door side at the time of closing the slide door 1 and detects whether the junctions are connected or not and supplies electricity to an actuator for carrying out a latch release RR by way of the junction switch 4*c* when the slide door 1 is in the fully closed condition.

In addition to the above-mentioned switches and sensors, for detecting the conditions of the vehicle, an IG (ignition) signal 4*g*, a shift P signal 4*h*, a foot brake signal 4*i*, an E/G signal 41, a signal from a vehicle speed sensor 4*k* which detects the vehicle speed, and signals from door sensors 43, 44 which detect the open/close condition of the slide door 1 are inputted to the input interface.

The door closer CZ performs the operation of the slide door 1 from the half latch condition to the fully closed condition at the time of closing the slide door 1 and the latch release RR performs the release of latch at the time of opening the slide door 1.

The signals and the vehicle condition signals (the IG signal, the shift P signal, the foot brake signal, E/G signal) from the above-mentioned various switches (cancel switch, the door open switch, the door close switch, the pole switch, the courtesy switch, the touch switch, the IG switch, the PKB switch) and sensors (the vehicle speed sensor, the door sensors) are inputted to the control unit CN, and in response to these signals, the controller 30 judges the vehicle conditions, and operates the slide motor 81 of the slide door 1 and the clutch CL by way of the drive circuit 32. The controller 30 also outputs the signal to the PWM control circuit 33 to make the PWM control circuit 33 output the PWM signal thus operating the brake clutch BK.

Figure 8:
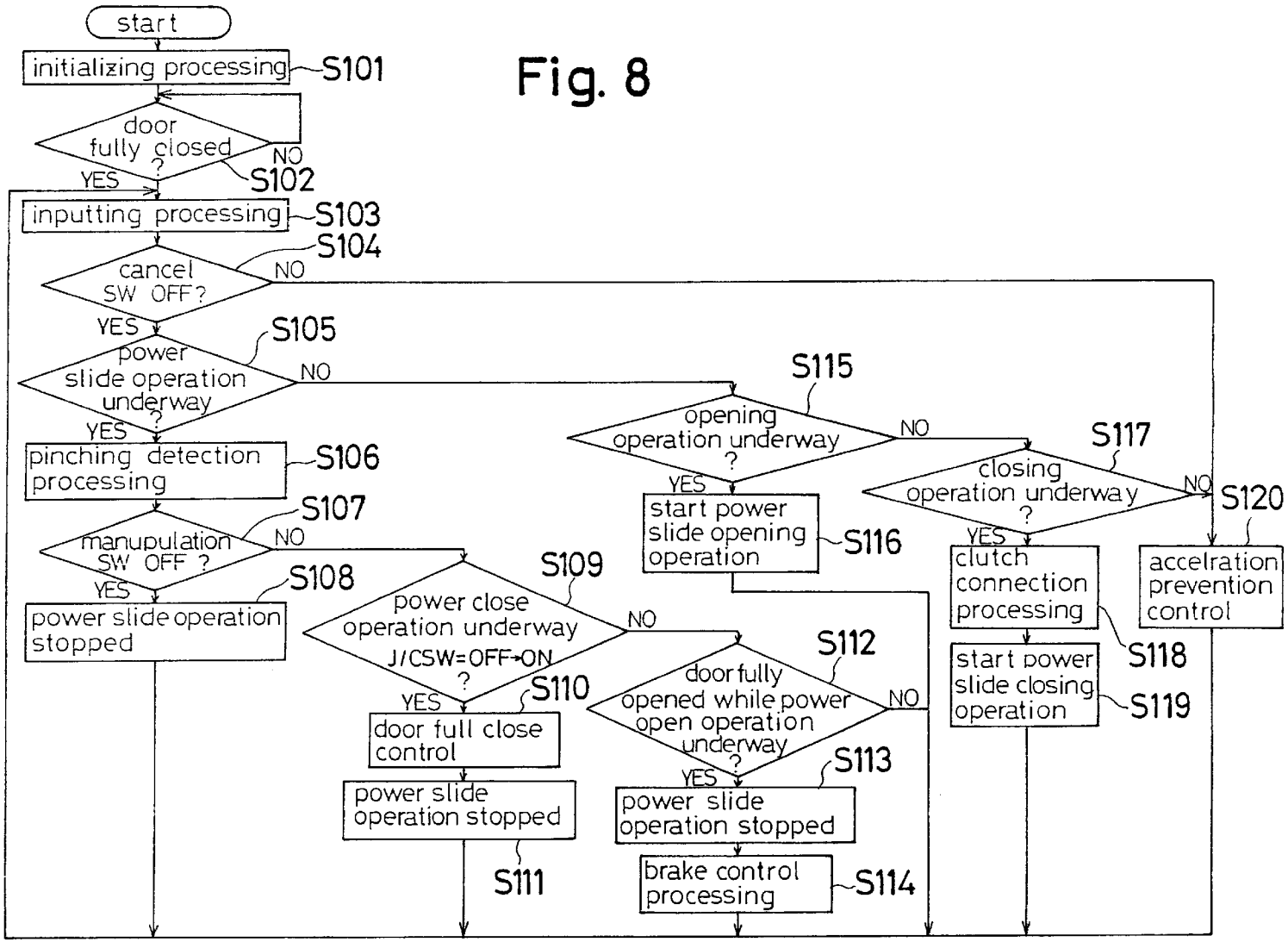
FIG. 8 is a main flowchart showing the processing carried out by the controller shown in FIG. 7.

The processing at the controller 30 of the control unit CN for operating the slide door 1 is explained in conjunction with FIG. 8. When electricity is supplied to the control unit CN from a battery, the control unit CN executes the main routine shown in FIG. 8.

In FIG. 8, an initializing is executed at step S101. Here, the conditions of ROM and RAM are checked and whether this system is normally operated or not is checked after setting initial values to memories necessary for this processing. At step S102, it is determined whether or not the slide door 1 is in the fully closed condition. The door fully closed condition is determined in view of the conditions of the pole switch 4*d* and the courtesy switch 4*e*. It is determined that the slide door 1 is in the fully closed condition when the pole switch 4*d* is in the latched condition (half latched condition or fully latched condition) and the courtesy switch 4*e* is in the OFF condition (door closed condition). At step S102, in case the slide door 1 is fully closed, an inputting processing is executed at step S103. In the inputting processing, when the signals from various switches and various sensors (see FIG. 7) indicating the current various vehicle conditions are inputted to the input interface 31 of the control unit CN, these signals are inputted to the controller 30 and stored in necessary memories in the controller 30.

Then, at step S104, it is determined whether or not the cancel switch 4*a* which cancels the electric operation (power slide operation) of the slide door 1 is pushed. Here, in case the cancel switch 4*a* is pushed (the ON condition), an acceleration prevention control which controls the movement of the slide door 1 is executed at step S120 and the processing returns to step S103. However, in case the cancel switch 4*a* is not pushed (the OFF condition), it is determined in step S105 whether or not the power slide operation is under way. The determination whether the power slide operation is under way or not is executed by watching the condition of the power slide opening and closing operation flag. In case the power slide operation is not under way, the processing is advanced to step S115. If the power slide operation is under way, the processing is advanced to step S106 where a pinching detection processing is executed. In this pinching detection processing, the pinching of a passenger or the like with respect to the body side (pillar) which may occur due to the movement of the slide door 1 is detected.

After executing the pinching detection processing, it is determined in step S107 whether or not the open or close manipulation switch 4*b* is pushed. If the manipulation switch 4*b* is not pushed, at step S108 the power slide opening and closing operations flag is cleared while holding the clutch CL in the ON condition and the motor 81 is turned off so as to stop the power slide operation and the processing returns to step S103.

In case the power slide operation is not under way at step S105, the processing returns to step S115. Here, it is determined whether or not the manipulation switch 4*b* is pushed to the open side and when the moment that the manipulation switch 4*b* is switched to the open side is detected, at step S116 the flag indicating that the power slide open operation is under way is set to start the power slide open operation and the processing returns to step S103.

On the other hand, in case the condition of step S115 is not established (other than the moment that the manipulation switch 4*b* is pushed to the open side), it is determined whether or not the manipulation switch 4*b* is pushed to the close side. Here, the moment it is detected that the manipulation switch 4*b* is pushed to the closed side, the clutch connecting processing is executed at step S118. In case the slide door 1 is electrically driven and the manipulation switch 4*b* is manipulated, when the slide door 1 is moved to a position of a given distance by manual manipulation, this clutch connecting processing energizes the coil 80 of the drive mechanism 8 to make the coil 80 generate the electromagnetic force which connects the clutch CL to make the rotor 98 and the ring member 95 integrally rotate, thus carrying out the power slide operation by the electric power. In this case, whether the door speed for moving the slide door 1 exceeds a given speed or not is checked and in case the door speed exceeds the given speed, a brake is applied by way of the brake mechanism BK in a direction to close the slide door 1 so as to slow down the moving speed of the slide door 1 and the clutch CL is connected. After completing the clutch connecting processing, the power slide close opening flag is set at step S119 and the processing returns to step S103.

In case the manipulating switch 4*b* is pushed to the open side or the close side at step S107, the processing at step S109 and ensuing steps are executed. At step S109, it is determined whether the junction switch 4*c* is changed over from the OFF condition to the ON condition during the power closing operation. That is, it is determined whether or not a female terminal mounted on a portion to which the slide door 1 of the body side is connected and a male terminal which comes into contact with the female terminal mounted at the slide door side are connected with each other during the slide door closing operation (to be more specific, the condition of the slide door 1 before the closer CZ is operated is between the condition that the slide door 1 is substantially closed at a position some ten mm in front of the fully closed position (the condition right before the half door condition or the half latch condition) and the fully closed condition). If the junction switch 4*c* is changed over from the OFF condition to the ON condition, at step S110 the operation is moved from the slide operation to the closer operation and the door closing control for closing the slide door 1 from the incompletely closed condition to the completely closed condition is executed. In step S111, the motor 81 is turned off, the clutch CL is turned off and the power slide close operation flag is cleared. After stopping the power slide operation, the processing returns to the step S103.

Figure 13:
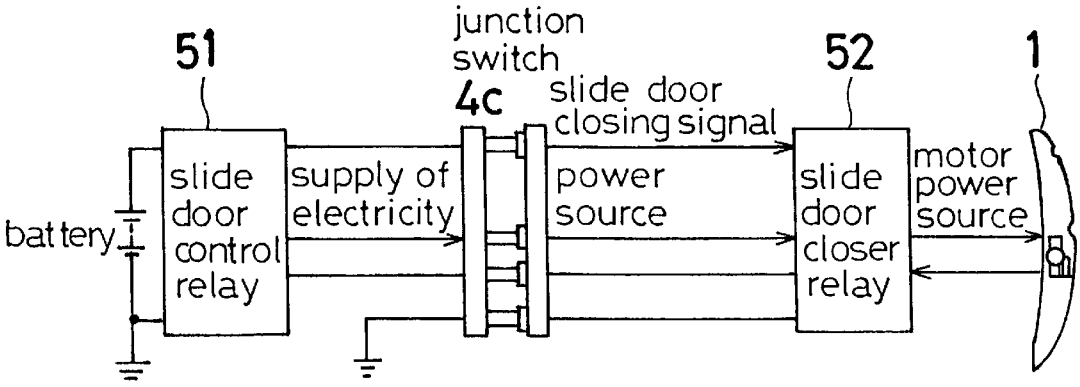
FIG. 13 is a schematic illustration showing the supply of electricity to the closer.

On the other hand, at step S109, if the junction switch 4*c* is not changed over from the OFF condition to the ON condition (not in a completely closed condition), it is determined at step S112 whether or not the slide door 1 is fully opened during the power opening operation this time. If the condition of step S112 is not established (in case the door is not fully opened during the power slide opening operation), the processing returns to step S103. In case the slide door 1 is fully opened by the power slide movement, at step S113 the motor 81 is turned off, the clutch CL is turned off and the power slide open operation flag is turned off so as to stop the power slide operation. Thereafter, because the slide door 1 is in the fully opened position here, at step S114 a brake control for intermittently applying the brake to return the slide door 1 to a position for holding the slide door 1 (the holding position where the rollers 5*a* of the roller units 5 for supporting the slide door 1 are stopped by the action of the check spring mounted on the vehicle-side lower guide rails) is executed in case the vehicle is in an inclined condition as well as in an open condition. Thus, the roller 5*a* is assuredly stopped by the stopping portion so that the door is in a free condition. Accordingly, as shown in FIG. 13(*a*), even when the vehicle is in an inclined condition and the clutch CL is turned off to make the slide door 1 in a free condition, the position of the roller 5*a* can be shifted to a stopper portion to prevent the slide door 1 in the open condition from overriding the stopper portion of the check spring so that the roller 5*a* is assuredly stopped at the stopper portion of the check spring and the slide door 1 can be held even when the vehicle is on an inclined or sloping surface.

The interruption processing shown in FIG. 9 is as follows. Signals from the door sensors 43, 44 are inputted to the control unit CN. If the leading edge and the trailing edge of this signal are inputted, the interruption processing is automatically executed against the main routine. At step S201, based on the edge direction of the door sensor 43 (DS1) and the electric potential level of another sensor 44 (DS2), the moving direction of the door is decided (see the interpretation of the flow). Thereafter it is determined whether or not the slide door 1 is moved in an opening direction from the fully closed condition (whether the signal is changed from the ON condition to the OFF condition). In case the slide door 1 is opened from the fully closed condition, the door position is reset as the door fully closed position and the time between an edge of DS1 and an edge of one preceding DS1 is obtained, and the inverse number thereof is calculated to obtain the door speed. In this processing, at the very moment the slide door 1 is opened, the value of the door position counter which stores where the slide door 1 is currently positioned is reset and initializing is executed at the fully closed condition. However, in case the slide door 1 is not opened from the fully closed condition, the reset is not executed and at step S203 the door position counter is incremented in an opening direction and decremented in a closing direction depending on the door moving direction and the door condition is stored sequentially. Thereafter, at step S205, because the distance between the edges is constant, the door-speed can be calculated by taking the inverse number of the edge interval time. More specifically, when the edge of DS1 is detected, the condition of DS2 at the point of time is read. If DS2 is high (high electric potential H) at the trailing edge of DS1, or if DS2 is low (low electric potential L) at the leading edge of DS1, it is determined that the slide door 1 is moved by one pulse in a door opening direction. If DS2 is low at the trailing edge of DSI, or if DS2 is high at the leading edge of DSI, it is detected that the slide door 1 is moved by one pulse in a door closing direction and the door fully closed position is initialized as the origin. Each time the edge enters DS1, the count number of the door position is increased or decreased to recognize the door position.

By virtue of this operation and construction, each time the edges are inputted from the door sensors 43, 44, this processing is executed and information on the door position, the door velocity and the moving direction of the slide door 1 is obtained as door information by the interruption processing.

Figure 10:
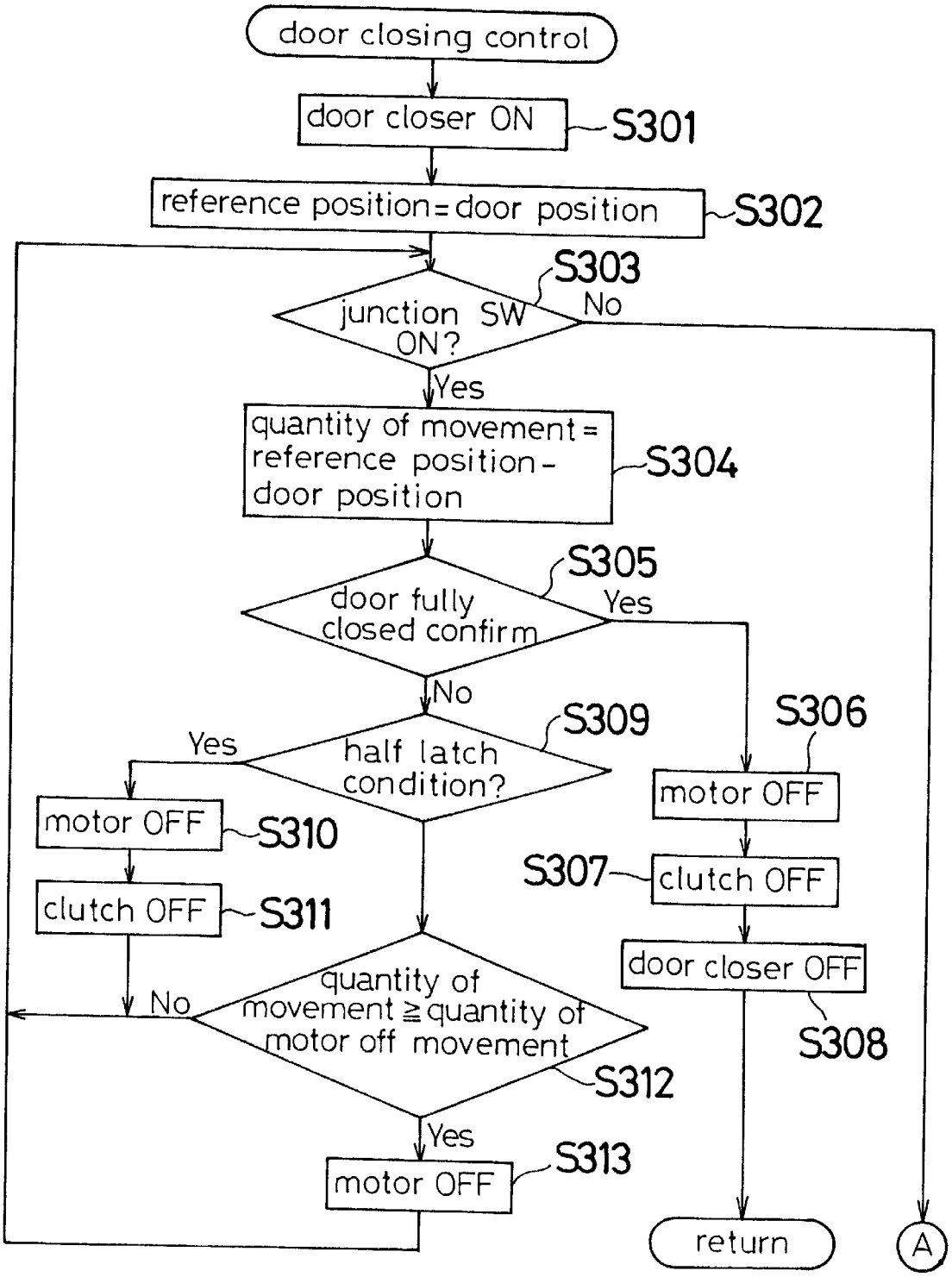
FIG. 10 is a flow chart showing the door closing control.
Figure 12:
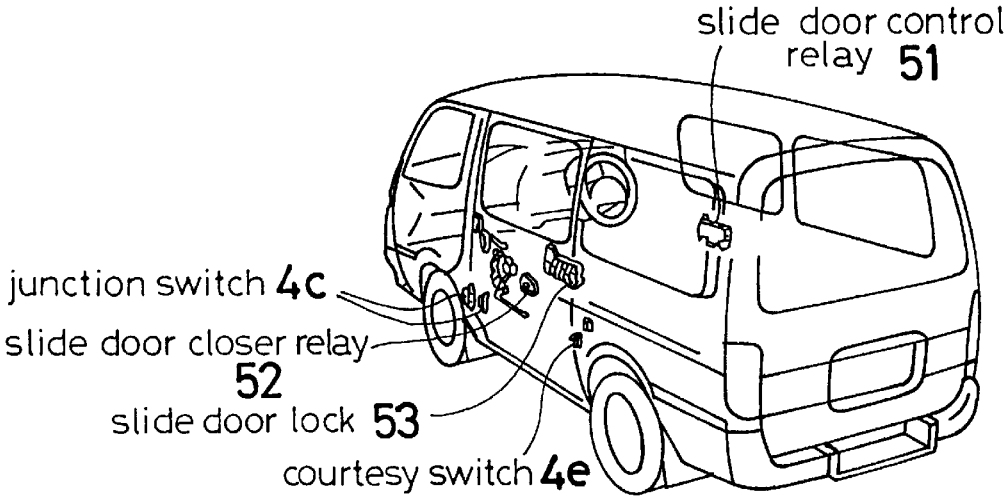
FIG. 12 is a perspective view of a vehicle showing the construction of the closer used in the present invention.

The door closing control of the present invention is explained in detail in conjunction with FIG. 10. Prior to the explanation of this control, the closer CZ that is used here is explained in conjunction with FIGS. 12 and 13. The closer CZ is provided for automatically closing the slide door 1 to the fully closed condition in case the slide door 1 is in the half door condition or half latched condition. When the slide door 1 reaches the half door condition, this half door condition is detected by the detection switch 4*c* and this signal is outputted to a slide door closer relay 52. Upon receiving this signal, the slide door closer relay 52 drives a full lock motor (not shown) which drives a slide door lock 53 to perform the normal rotating operation, thus moving the slide door 1 to the fully closed condition.

The door closing control of the present invention is explained in detail in conjunction with FIG. 10. Prior to the explanation of this control, the closer CZ that is used here is explained in conjunction with FIGS. 12 and 13. The closer CZ is provided for automatically closing the slide door 1 to the fully closed condition in case the slide door 1 is in the half door condition or half latched condition. When the slide door 1 reaches the half door condition, this half door condition is detected by the junction switch 4*c* and this signal is outputted to a slide door closer relay 52. Upon receiving this signal, the slide door closer relay 52 drives a full lock motor (not shown) which drives a slide door lock 53 to perform the normal rotating operation, thus moving the slide door 1 to the fully closed condition.

Then, at step S303, it is determined whether or not the junction switch 4*c* is set at the ON condition (where a female terminal mounted on a portion of the vehicle side with which the slide door 1 comes into contact is connected with a male terminal which is mounted on the slide door side and is brought into contact with the female terminal). If the junction switch 4*c* is not turned on (i.e., the terminals are not connected) so that the slide door 1 is not yet fully closed, the processing returns to A of the main routine (step S103). If the junction switch 4*c* is turned on (i.e., the terminals are connected), a deviation of the current door position from the reference position is taken and a quantity of movement of the slide door 1 from the reference position where the closer operation is started is calculated at step 304.

Then, at step S305, the door fully-closed condition confirmation is checked by the pole switch 4*d* and the courtesy switch 4*e*. If the door is fully closed (i.e., a signal indicative of the fully closed condition is outputted), the processing is moved to step S306. If the door is not fully closed, the processing is moved to step S309. In case the door is fully closed, at steps S306 to step S308, the motor 81 is turned off (the energization of the motor 81 is stopped), the clutch CL is turned off (the energization of the coil 80 is stopped), and the door closer CZ is turned off, thus completing this processing. If the signal output is not indicative of the fully closed condition, it is determined at step S309 whether or not the door condition is the half latch condition. Here, in case the condition of the pole switch 4*d* is indicative of the half latch condition, the motor 81 and the clutch CL are turned off at steps S310, S311 and then the processing returns to step S303.

On the other hand, if the condition of the pole switch 4*d* is not indicative of the half latch condition, it is determined whether or not the quantity of movement is equal to or greater than the motor OFF quantity of movement for stopping the motor 81 (the quantity of movement is set 7.25 mm from the difference position). If the quantity of movement has not yet reached the motor OFF quantity of movement, the processing returns to step S303, whereas if the quantity of movement has reached the motor OFF quantity of the movement, the motor 81 is turned off at step S313 and the processing returns to step S303.

If the junction switch 4*c* is turned on (i.e., the pair of terminals are in a connected condition), in the processing at step S303 and succeeding steps, because the door condition does not reach the door fully closed condition or the half latch condition immediately, usually when the junction switch 4*c* is turned on, the slide door 1 is moved up to the motor OFF quantity of movement (7.25 mm after connection) and then the motor 81 is turned off. That is, steps S305 and S309 which are executed after the turning on of the junction switch 4*c* are provided for fail safe purposes and in case the pole switch 4*d* or the like suffers from a failure, the proper control cannot be executed and so the motor 81 and the clutch are turned off.

Figure 11:
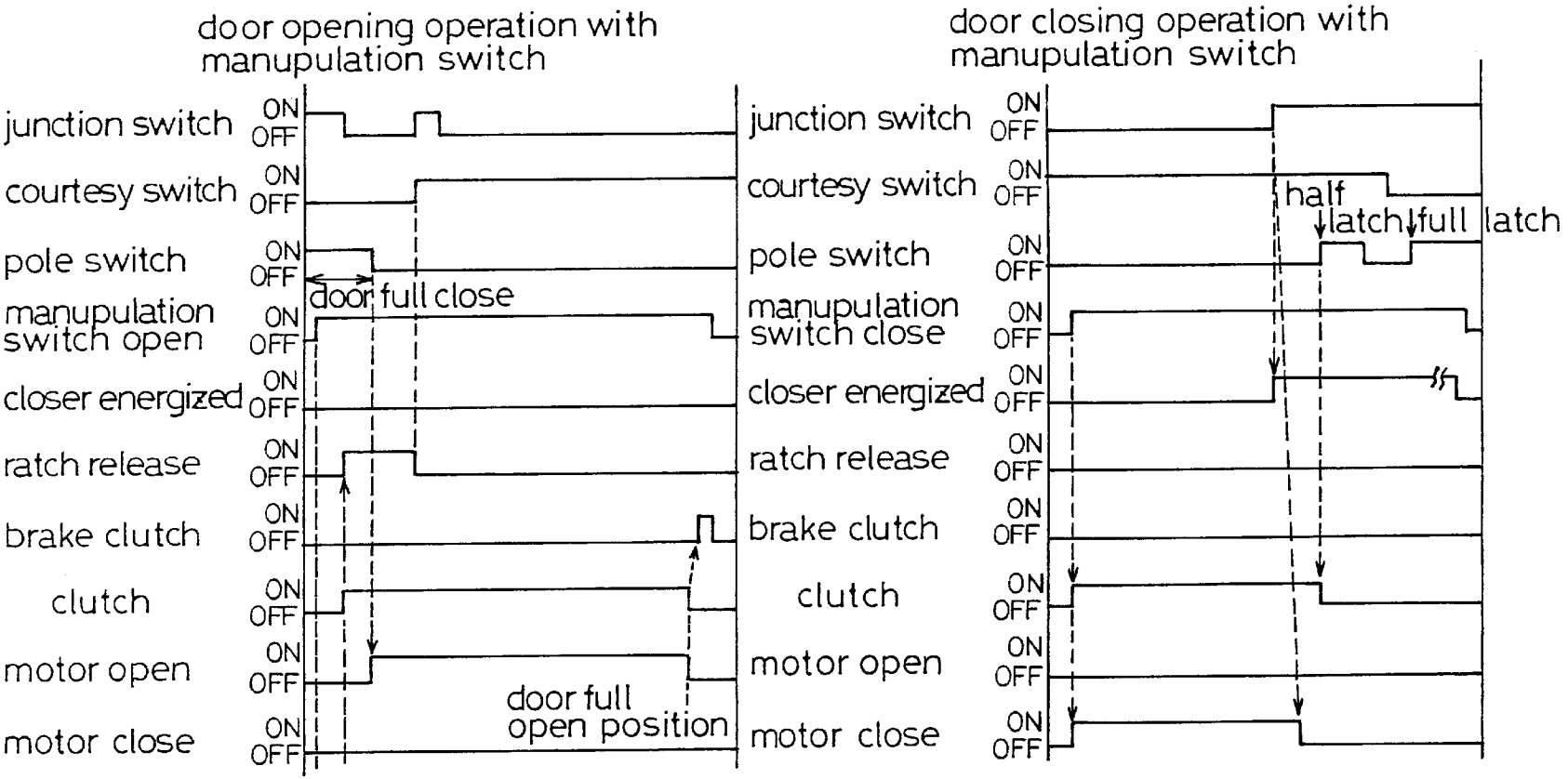
FIG. 11(*a*) is a timing chart showing the conditions of the various switches inputted to the controller and the output signals from the controller during a door opening operation by a manipulation switch.

That is, in this processing of the closing side, when the manipulation switch 4*b* is manipulated (pushed) to the closing side as shown in FIG. 11(*b*), the clutch is turned on at his time and the electrically operated drive of the side door 1 is started. The slide door 1 is then gradually closed by electrically operated operation and the [terminal of the] junction switch 4*c* is turned on (i.e., the ON condition). In this condition, the closer CZ is energized and electric power is supplied to the door closer CZ through the connecting mechanism so that the operation of the closer CZ is started. In this condition, the motor 81 for operating the slide door 1 is simultaneously operated. That is, the slide door 1 is pulled in by the closer CZ and the slide door 1 is pushed by the geared cable 6 with the driving force generated by the motor 81. This implies that both drive devices (the closer CZ and the electrically operated slide door device) are operated. Here, by operating both devices in an overlapping manner, the shift of the operation from the motor operation to drive the slide door 1 to the closer operation becomes smooth. Then, the pole switch 4*d* achieves the half latch condition, the clutch which performs the electrically operated operation is turned off and the motor 81 is turned off when the slide door 1 is moved a given distance (7.25 mm) after the junction switch 4*c* before the half latch is connected (ON). By stopping the operation of the drive of the motor 81 here, it is unnecessary to supply a large electric current to the motor 81.

The distance which turns off the motor 81 is determined based on two conditions, namely the small electric current value and the small force to the drive medium, and the position which reliably pulls the slide door 1 by the closer CZ.

If the closer CZ has not yet reached the position to pull in the slide door 1, when the clutch CL is turned off (the electrically operated operation is released), the condition of the slide door 1 is set to the free condition so that in spite of pushing the slide door 1 in a closing direction by way of the geared cable 6 to the position where the closer CZ can pull in the slide door 1, at the moment that the clutch CL is turned off, the slide door 1 is moved toward the open side due to the repulsive force or the like of a weather strip provided at the periphery of the slide door for preventing the intrusion of the wind and rain into the inside of the vehicle. In this manner, when the slide door 1 returns to the open side after the closing operation due to the repulsive force or the like of the weather strip, the slide door 1 cannot be closed by the closer CZ. Accordingly, in this embodiment, when the half latch condition is detected after the motor 81 is turned off, the clutch is turned off.

After the motor is turned off, the slide door 1 is closed such that the opening of the vehicle is fully closed by the closer CZ alone. Here, when the slide door 1 reaches to the half latch condition because the door is not moved to the open side from that position, the clutch CL is turned off and then the slide door 1 is closed to the fully closed condition by the closer CZ alone.

In accordance with the present invention, a door control device is provided in which a closer shifts the door from the half door condition to the fully closed condition, and a clutch mechanism is interposed in the power transmission system between the door and a motor for driving the door. If the door is electrically driven, the clutch of the clutch mechanism is connected to operate the door and a closer operation is started after a given condition. The connecting mechanism establishes a connection to supply electricity to the closer from right before the half door condition to the fully closed condition, and the door condition detecting mechanism detects whether the door is in the half door condition or in the fully closed condition. During the door closing operation, in case the connecting mechanism is connected to supply electricity to the closer, the closer operation is started and then, when the door is moved a given distance, the drive of the motor connected to the clutch mechanism is stopped.

By virtue of this construction, if the connecting mechanism which establishes the electrical connection is connected from right before the half door condition to the fully closed condition, the closer operation is started so that the door drive operation due to the clutch connection and the closer operation can be overlapped. Hence, when the connecting mechanism is connected and the motor is stopped when the door is moved a given distance, the closer can be operated from right before the half door condition.

For example, in the case of a slide door of a vehicle in which the slide door is moved by pushing by way of a drive mechanism, the deflection of the weather strip can be held small in this condition so that the repulsive force also can be made small. Accordingly, the force necessary for moving the slide door can be reduced by the pushing force against the repulsive force of the weather strip. Furthermore, since it is no longer necessary to move the slide door to the half door condition by the slide operation, the motor which moves the slide door by pushing can be made relatively small in size compared to the motor used in other known devices of this type.

When the output of the door condition detection mechanism indicates the half door condition, the clutch connection of the clutch mechanism is interrupted, and when the door is moved to the filly closed condition, the closer operation is stopped so that the door can be transferred to the closer as fast as possible, so that the motor connected with the clutch mechanism can be stopped earlier, and so that the shifting of operation from the slide operation to the closer operation can be smoothly performed, thus enabling the miniaturization of the motor and the lowering of the required electric current. Furthermore, it is unnecessary to make the drive mechanism as strong as is the case with other known drive mechanisms.

The principles, preferred embodiment and modes of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A door control device adapted to be operatively associated with a sliding door for controlling movement of the door between an open condition and a closed condition, comprising:

a drive device which moves the door from the open condition towards the closed condition;

output means for outputting a signal in advance of the door reaching a half-latch condition while the door is moving towards the closed condition;

a closer which is actuated to move the door from the half-latched condition to a fully latched condition in response to the signal outputted by the output means; and the drive device being deactivated when the door is moved a predetermined distance after actuation of the closer.

2. A door control device according to claim 1, further comprising:

detecting means for detecting whether the door is in the half latched condition.

3. The door control device according to claim 1, wherein the closer is supplied with electricity to move the door to the fully latched condition and the detecting means also detects the fully latched condition, and including a clutch mechanism which establishes and interrupts a coupling between the door and the drive device, the coupling between the door and the drive device by the clutch mechanism being interrupted when the half latched condition is detected by the detecting means, and the supply of electricity to the closer being interrupted when the fully latched condition is detected.

4. The door control device according to claim 1, wherein the detecting means is a pole switch.

5. The door control device according to claim 1, wherein the output means is a junction switch.

6. A door control device according to claim 5, further comprising:

a connecting mechanism which establishes an electric connection in which electricity is supplied to the closer.

7. A door control device operatively associated with a door mounted on a sliding vehicle to control movement of the door between an open condition and a closed condition, comprising:

a drive device which, upon operation, moves the door from the open condition towards the closed condition;

output means for outputting a signal in advance of the door reaching a half-latch condition while the door is moving towards the closed condition;

a closer which is operated in response to the signal outputted by the output means to move the door from the half-latched condition to a fully latched condition; and the operation of the drive device moving the door towards the closed position overlapping with the operation of the closer moving the door from the half-latched condition to the fully latched condition.

8. The door control device according to claim 7, wherein the closer is supplied with electricity to move the door to the fully latched condition and the detecting means also detects the fully latched condition.

9. The door control device according to claim 8, including a clutch mechanism which establishes and interrupts a coupling between the slide door and the drive device, the coupling between the door and the drive device by the clutch mechanism being interrupted when the half-latched condition is detected by the detecting means, and the supply of electricity to the closer being interrupted when the fully latched condition is detected.

10. A door control device according to claim 7, including detecting means for detecting whether the door is in the half-latched condition.

11. The door control device according to claim 10, wherein the detecting means is a pole switch.

12. The door control device according to claim 7, wherein the output means is a junction switch.

13. The door control device according to claim 7, including a connecting mechanism which establishes an electric connection in which electricity is supplied to the closer.

* * * * *